United States Patent [19]

Burley et al.

[11] Patent Number: 4,728,536

[45] Date of Patent: Mar. 1, 1988

[54] METHOD FOR INSULATING AN ICE RINK

[75] Inventors: William G. Burley, Salix, Pa.; John S. Burley, R.D. #1, Box 431, Apt. B-13, Beautyline Dr., Salix, Pa. 15952

[73] Assignee: John S. Burley, Salix, Pa.

[21] Appl. No.: 924,319

[22] Filed: Oct. 29, 1986

[51] Int. Cl.[4] ..... B05D 1/30

[52] U.S. Cl. ..... 427/154; 62/235; 62/420; 165/135; 165/915; 422/38; 422/40

[58] Field of Search ..... 427/154, 398.1, 420; 422/38, 40; 165/135, 915; 62/235

[56] References Cited

U.S. PATENT DOCUMENTS 4,281,802 8/1981 Burley ..... 242/55

FOREIGN PATENT DOCUMENTS 1528447 10/1978 United Kingdom ..... 62/235

OTHER PUBLICATIONS

Ohio Agricultural Research & Del. Ctr. and Energy Research and Del. Administration Conference Bulletin, Mar. 20, 1977, p. 21.

*Primary Examiner*—Janyce E. Bell

*Attorney, Agent, or Firm*—Franklin D. Wolffe; Morris Fidelman

[57] ABSTRACT

Temporarily insulating frozen surfaces, such as ice rinks, from the ambient air by spreading a metastable liquid foam over the ice surface to remain thereon when the ice surface is not in use, then prior to the next use period, removing the aged, partially frozen foam. Fire fighting foam liquids are preferred embodiment foaming agents.

6 Claims, 5 Drawing Figures

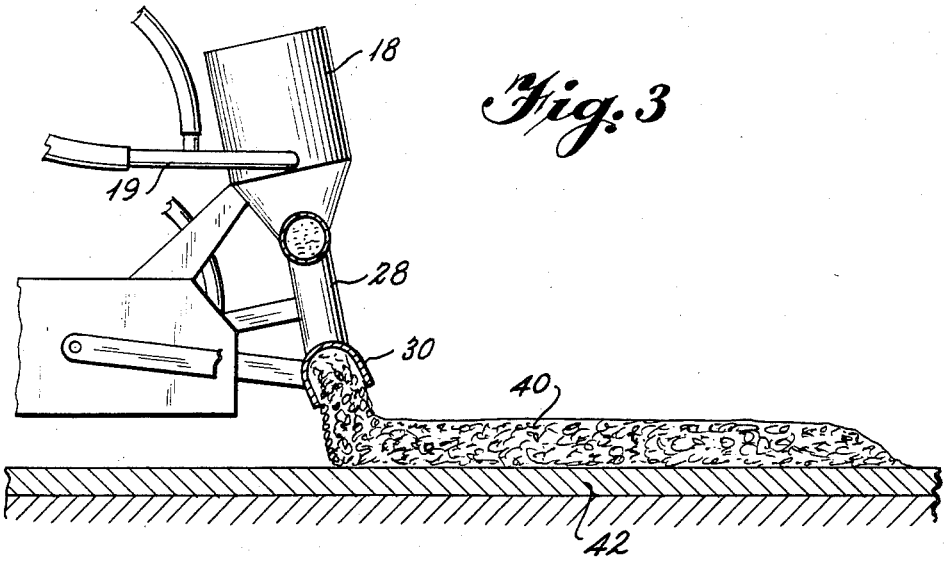
Fig. 3
Fig. 4
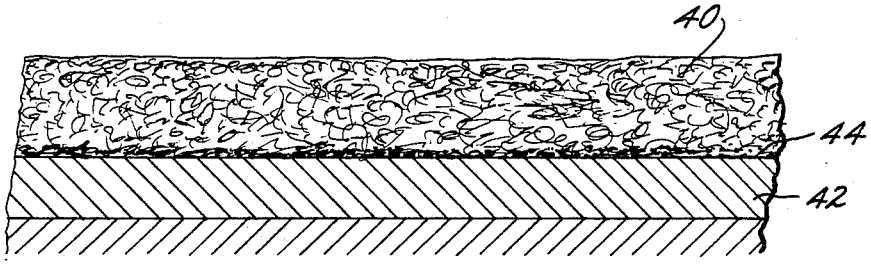
Fig. 5
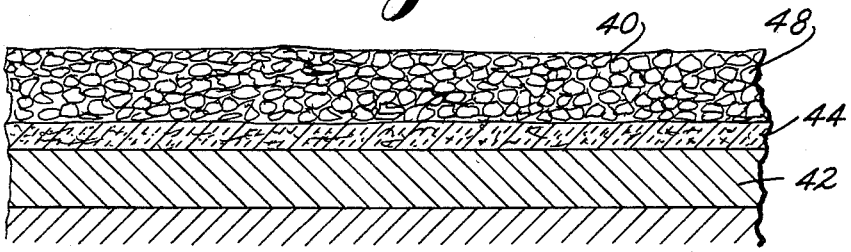

METHOD FOR INSULATING AN ICE RINK

This invention relates to a method for controlling the transfer of heat between an ice rink and the surrounding region and, in particular, relates to a method for insulating an ice rink with a metastable temporary liquid foam.

BACKGROUND OF THE INVENTION

The ever increasing popularity of ice skating has transformed this recreational activity from its original strict limitation to a wintertime activity in regions with cold winters, ice skating being possible only when local rivers, lakes and ponds have frozen. For many years now, ice skating has been an activity wherein spectators can view the action in comfort and the participants are not subjected to sub-freezing temperatures. Many ice rinks are in enclosed arenas with the ice surface of the rink generated and maintained through mechanical refrigeration.

An enclosed ice rink constitutes an unstable thermodynamic system. The enclosure as a whole, as for example a roofed over shopping center, must be maintained at temperatures comfortable for shoppers and employes, e.g., 70°-75° F., through heating or cooling as necessary. Yet, the ice rink typically, 17,000 square feet in area, must be maintained in a frozen state by refrigeration. Unavoidably, large quantities of heat traverses the large interface between the relatively warm ambient air and the cold ice rink surface by conduction, convection and radiation. The surface ice layer of the rink is warmed and melted; correspondingly, the arena, as a whole, is chilled, all of which imposes a high cooling load on the ice rink refrigeration system. Unfortunately, the adverse thermodynamics of the system cannot be avoided while the ice rink is in use.

However, many, if not most, enclosed ice rinks are not operated for many hours of the day, the wee hours of the morning for example, and often are out of operation for up to eight, ten, even twelve hours at a stretch. During the off-hour period, no reason exists for allowing the ice surface to chill the arena enclosure and conversely for allowing the relatively warm enclosure to cast a heavy refrigerating load on the ice rink refrigeration system. Isolating the ice surface from the enclosure during out-of-operation periods is manifestly advantageous.

Workers in the art have appreciated the desirability of insulating the ice rink temporarily. For example, U.S. Pat. No. 4,281,802, an earlier invention made by an inventor hereof, suggests deploying a thermo-insulating blanket over the ice surface during periods of non-use. The present invention achieves the same insulation objectives through a completely different approach.

Accordingly, the objective of this invention is to thermally isolate an ice rink from its surrounding enclosure during non-use periods of time.

BRIEF STATEMENT OF THE INVENTION

Briefly stated, the method of the present invention comprises spreading a biodegradable metastable liquid foam on top of the ice rink surface when the ice rink closes, then just before the ice rink reopens, removing what has become a partially frozen and aged foam from the surface of the ice rink, and conditioning the skating surface for a renewed period of use.

DISCUSSION OF THE INVENTION

Above all, the method of this invention is a practical system, it may be carried out with resurfacing equipment already present at virtually every ice rink, save for a foam generating means, and the foam generating means may be an add-on accessory for the state-of-the-art resurfacer machines.

In addition, practice of the method is relatively low cost. Foam expansions, as high as a thousand to one, may be obtained as a routine matter with commercially available foaming equipment (most of the liquid in the metastable liquid foam is water). Surprisingly small quantities of foaming agent (really a foam stabilizer) are needed to generate large volumes of metastable liquid foams.

It so happens that the same aqueous foams useful for fighting fires will serve in practice of this invention. In consequence, the off-the-shelf (i.e., commercially available) foam generating equipment and foam liquid concentrates that are offered to municipal and volunteer fire departments constitute preferred embodiments of foam generators and of foam liquid concentrates for practice of this invention. It may be noted that the foam liquid concentrates are biodegradable, which allows disposal of the collapsed foam into local sewer lines.

Since state-of-the-art foam liquid concentrates are contemplated for preferred practice of this invention, detailed discussion thereof is not necessary here.

As has already been indicated, the major components from which the apparatus of this invention is assembled are a pair of off-the-shelf, state-of-the-art units, specifically an ice resurfacer and a foam generating system. Thus, for example, the Zamboni TM 520 ice resurfacer may be modified to include a state-of-the-art foam generator, the WP-25 (National Foam System, Inc.) for one.

In detail, the ice resurfacer, a servicing vehicle present in virtually every ice rink complex, is employed to generate and spread the metastable liquid foam. The water supply tank and water pump of the resurfacer serves as source for the water converted into foam. A small tank of 1-5 gallon capacity is added to the conventional resurfacer for storing the foam liquid concentrate (or foam liquid). Also added is a state-of-the-art air aspirated foam generating system, e.g., the WP-25, to which the water and foam liquid tanks are connected. Parenthetically, it is noted that the state-of-the-art foam generating system includes a metered valve mixer for water and the foam liquid; and an air aspirating nozzle to which the mixture is supplied; optionally, a water pump; and, of course, a liquid flow line appropriate to connect the water to the foam generating system. The foam generating system is controlled from where the operator of the resurfacer sits, as, for example, with switches to operate metering valves and the water pump.

The water tank on the state-of-the-art ice resurfacer has a water capacity of about 200 U.S. gallons and this is more than enough to generate a relatively dry foam, e.g., at 1000 to 1 expansion ratio in sufficient volume to create a foam layer several inches deep over the entire surface of the ice rink, as for example at least about 2" in thickness. It may be noted that the foam concentrate constitutes not more than about 6%, and preferably about 1½% or less of the aqueous mixture converted into foam. Accordingly, a 1-5 gallon tank is adequate storage capacity for the foam, but desirably at least about 1% of foam liquid concentrate is employed liquid concentrate. It is noted also that a three inch layer of metastable liquid foam can be expected to have an R value of approximately 4, constituting a good insulating layer. As a practical matter, a two inch foam layer is adequate to insulate the ice surface.

Once the foam has been applied over the ice surface, it can remain there quiescent and undisturbed, except for convection currents, to serve its intended purpose of insulating the ice sheet from the arena as a whole.

The thermal performance of the foam insulating layer will, of course, vary from foam to foam, and ice rink to ice rink, and with time as foam ages. Also, the thermal load imposed on the ice sheet will vary from rink to rink depending, of course, upon the convection, radiation and moisture vapor thermal loading unique to each ice rink. Suffice it then to say only that a 3" thick layer of metastable liquid foam on the rink surface will decrease the cooling load on the ice rink refrigeration system by 70% or more.

It should be appreciated that the thermodynamic imbalance between the ice sheet and the ambient air of the area applies to the foam and affects the foam. The bottom of the foam layer is in direct freezing contact with the ice sheet, the top of the foam layer is in direct contact with the relatively warm ambient air of the enclosed arena. In addition, the foam itself ages with passage of time.

As is well known in the foam art, metastable quiescent foams undergo a life cycle. A typical foam can be considered to commence the life cycle as a body of liquid which contains therein a multiplicity of generally spherical air bubbles. Gradually, as the force of gravity causes liquid to drain out of the foam, the spacing between adjacent air bubbles thins out and the body of liquid is converted into a multiplicity of thin liquid films separating adjacent pockets of air. In this stage of the life-cycle of the foam, the multiplicity of air pockets in the foam as a whole stretch into polyhedral form for which proposed models have been the geometric forms of dodecahedron and beta-tetrakaidecahedron. Then air diffuses away from small pockets into larger pockets; some of the air pockets dwindle away, other air pockets coelesce. With age the foam coarsens and eventually collapses.

The normal life cycle span of foams may be predetermined. Pure water foams collapse almost immediately. Beer foams last not quite an hour. Through appropriate selection of foaming agent and foaming agent proportions predetermined life cycle spans may be obtained. Twelve hour life cycle spans for the foam is believed to be more than adequate for purposes of this invention and such a span may be obtained routinely with state-of-the-art fire fighting foam liquids e.g., the Aer-O-Foam® (Natural Foam Systems, Inc.) and UHX½ (Akron Brass Co.) foam liquids.

In the instance of a foam blanket on the surface of an ice rink, the normal life cycle of a metastable liquid foam is altered by the substantial thermal gradient across the foam. The top of the foam layer is exposed to convection currents of relatively warm ambient air. The bottom of the foam layer rests on a sheet of subfreezing temperature ice. Typically, the ice surface temperature is within the range of about 14° F. to 25° F. Therefore, significant thermal effects are imposed upon the foam during its life cycle. In specific, the bottom of the foam commences freezing to solid state virtually the moment the foam is laid down on the ice surface.

A layer of frozen foam forms very quickly, because heat exchange through the foam and across the air-foam interface is relatively poor as compared to heat exchange across the foam-ice interface, such being a liquid-ice interface. The frozen foam constitutes an insulating sub-blanket of its own. Desirably, the top of the foam remains in liquid form as an aging metastable liquid foam. The bottom of the foam is relatively unchanged reticulated ice. The liquid foam-ice foam interface is at the interior of the foam blanket.

Accordingly, a good many hours after the metastable liquid foam has been applied on the ice surface, by the time the ice rink is near to reopening, the foam will have aged into a coarse liquid foam resting on a relatively unchanged sub-layer of frozen foam.

Transformation of the foam over time into a coarse liquid foam and reticulated ice is an important aspect to practice of the invention, because removal of the foam is necessary before the ice rink can be reopened for use by the skaters. Operating the resurfacer over the ice sheet in normal resurfacing lifts all of the foam blanket from the ice sheet and transfers the blanket into the snow holding tank on the resurfacer. Shear and other forces applied to the foam during transfer of the aged liquid foam and frozen foam blanket into the snow holding tanks collapses the reticulated ice and coarse foam to a significant extent, substantially reducing thereby the volume of foam. The material removed from the ice rink surface to the snow melting pot constitutes some fraction of the original foam volume. The coarse liquid foam and collapsed ice shards dumped into the snow melting pit to drain away over time need not exceed the volumetric capacity of the pit. Ultimately, the foam collapses and drains away with the melted ice.

It is important to approach actual practice of the present invention from the conceptual standpoint described above, since the circumstances of each ice rink are quite individual, as for example, ice temperature, degree of air circulation above the ice, and to what extent the cooling output from the refrigeration system can be reduced overnight. Thus, a great many circumstances beyond the immediate control of the ice rink operator must be accepted and dealt with. The operator has control over the foaming agent, e.g., better or worse foaming agents, proportions of foam liquid in the foam, and the height of foam applied. In total, the operator has sufficient control to generate a foam such that at the end of the 4, 8, 12, whatever hours that the ice rink is not in operation, the top of the foam layer will have aged into a coarse, frangible liquid foam, and the bottom into a reticulated (thin walled) mass of frozen foam, which together are still of a thickness near to the thickness of the freshly applied foam layer. The energy saving is in some proportion to the average thickness of foam during the period of time the foam layer covers the ice.

Fortunately, the operator of the ice rink faces a relatively loose fit or sloppy situation; meticulous control is not required. The good heat exchange contact between the bottom of the foam layer and the ice rink surface ensures freezing of a significant height of foam long before collapse of the metastable liquid foam can take place, generating thereby a reticulated ice blanket of significant insulating value. Then, to whatever extent a liquid foam blanket above the reticulated ice has not collapsed, the insulating value of the foam layer is enhanced. The loose fit frees the operator from need to change operating procedure, if closing hours are not always the same, day to day. A few hours more or less than usual will have little effect on the foam insulating system.

By the same token, existence of a loose fit allows "cut and try" methods to always produce some reasonable optimum for each individual ice rink, and allows use of virtually any foaming material offered as such to the art. Indeed, soap or even foaming liquid detergents oan suffice, but are not preferred. Preferred foaming agents are the hydrophilic proteins. Especially preferred are the fire fighting foam liquid concentrates. Their principal advantage, commercial availability aside, is that they generates foams of extended life span and are recognized to be biodegradable. The foaming agents, per se, form no part of this invention. The quality and concentration of foaming agents to be employed are matters within the choice of the operator.

EXEMPLARY MODES OF THE INVENTION

As has already been indicated, an advantage to practice of the present invention is the capability for employing state-of-the-art ice skating rink resurfacer machines. Accordingly, for further understanding of the invention, the exemplary description which follows will be posed in terms of such a preferred mode and in particular with reference to the attached drawings wherein FIG. 1 diagrammatically illustrates a modified resurfacer machine.

FIG. 2 diagrammatically illustrates the foam supply system.

FIG. 3 illustrates in cross-section the application of the foam layer.

FIG. 4 illustrates in cross-section a portion of freshly applied foam.

FIG. 5 illustrates in cross-section a portion of aged foam.

Figure 2:
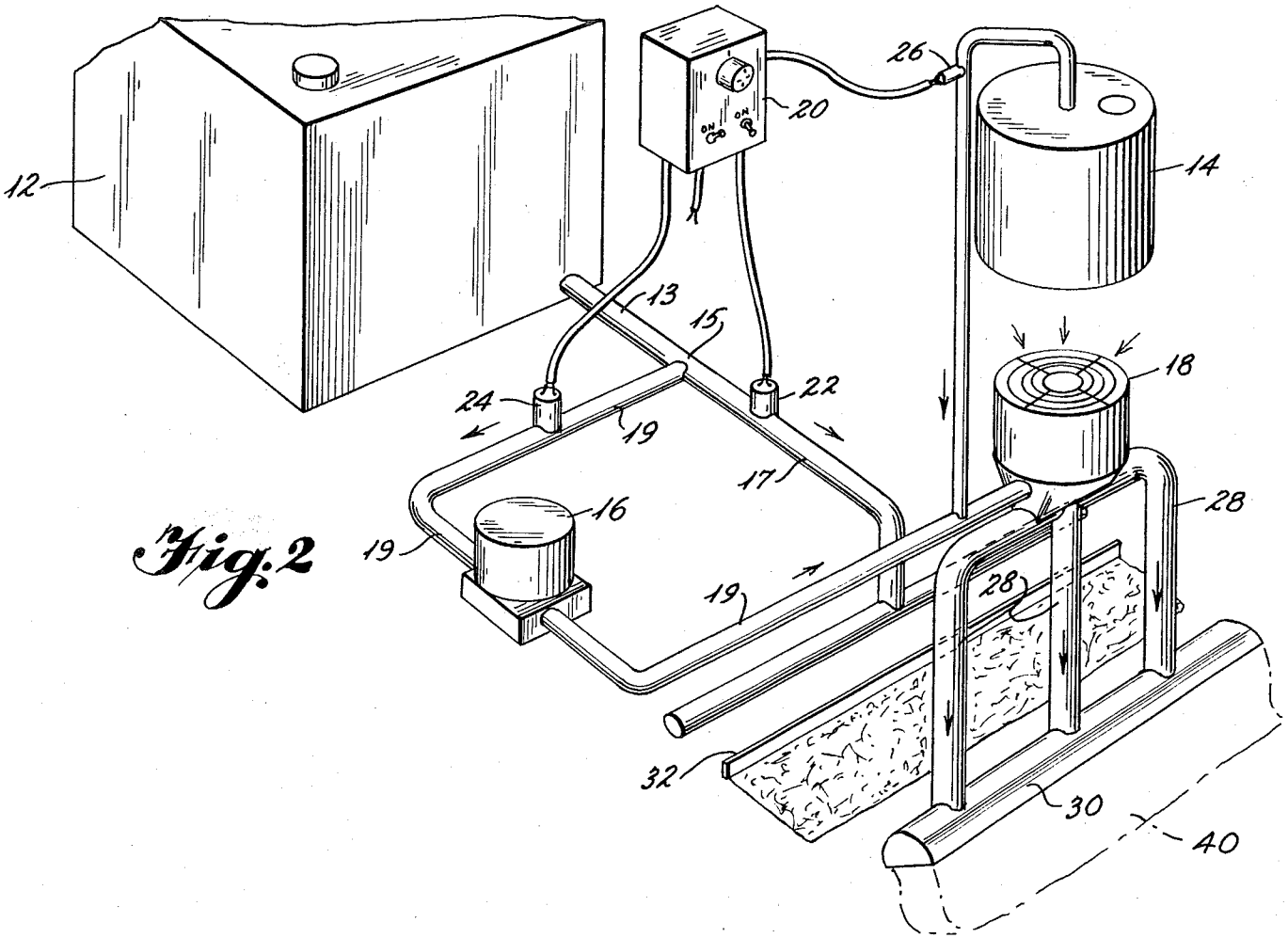

The equipment for applying the foam layer may be seen best in FIG. 2, wherein same is diagrammatically illustrated.

Thus, a typical state-of-the-art resurfacer is modified to include a sub-assembly adapted to apply the metastable liquid foam. The sub-assembly comprises a small tank 14 adapted to contain concentrated solution of the foaming agent which is connected to the water line leading from water tank 12 on the resurfacer so that foaming agent concentrate, e.g., 1½% by volume will be metered into the water coming from tank 12 by way of pump 16.

The water line 13 from tank 12 leads to Tee 15 from which it alternatively flows to the water towel bar line 17 or by way of line 19 to pump 16, then to the foam generator 18. Line 21 meters foaming agent from tank 14 into line 19. Flow of water and of foaming agent is regulated from controller 20 by automatic metering valves 22, 24 and 26.

The water and foaming agent in admixture feed through the air aspirating nozzle of a standard foam generator 18. The foam generated in generator 18 passes through ducts 28 to foam spreader 30, then as a layer 40 several inches thick, over the ice rink surface as illustrated in the drawing, during advancing movement of the resurfacer.

Figure 1:
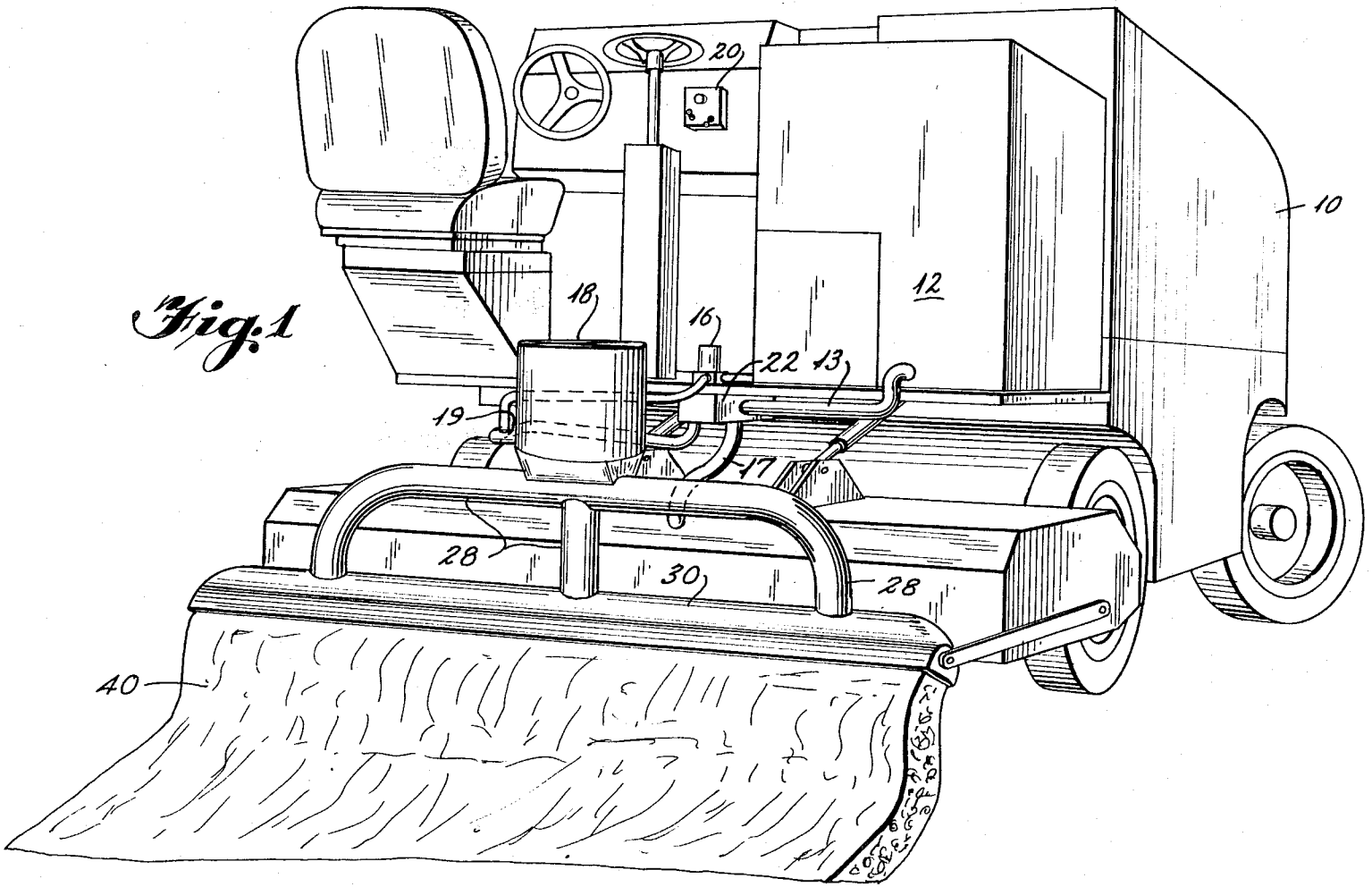

FIG. 1 illustrates how the foam sub-assembly mounts on a resurfacer 10, connecting to the water tank 12 therein. The controller 20 is positioned adjacent the steering wheel convenient to the operator. Not shown for clarity is the concentrate tank, which is mounted aft of water tank 12. The towel bar 32 is shown as removed (see FIG. 2). When normal resurfacing is to be carried out, the foam generator 18, ducts 28 and foam spreader 30 is unbolted and otherwise uncoupled from resurfacer 10.

Thus, to apply the foam, the resurfacer water tank 12 being then filled with cold water, e.g., 200 gallons, and foam concentrate liquid then filling concentrate tank 14 and the foam sub-assembly then being connected to controller 20 as illustrated in FIG. 2, the operator drives resurfacer 10 onto the ice sheet. Then the foam generator as a whole is started, to commence with forced air aspiration and thereafter to pump water and foam concentrate so that a mixture of water and foam concentrate flows into the foam generator 16 to be foamed therein. The foam flows through ducts 28 and spreader 30. Once foaming has started, the operator advances resurfacer 10 over the entire skating rink in any pattern normal to resurfacing operation. It may be necessary to adjust resurfacer speed for optimum foam coverage. If vehicle speed is too slow, the operator will experience overflow of foam to the front of the spreader 30. If the speed is too fast, the foam cover will be inadequate, either too thin or incomplete coverage. The foam exiting from spreader 30 becomes a layer 40 of foam on the ice rink surface 42 (see FIG. 3).

As has already been indicated, the bottom portion of the foam layer 40 commences to freeze almost immediately to form a sub-layer 44 of frozen foam, such being illustrated in FIG. 4. Over time the liquid foam ages, forming thereby a top portion of sub-layer of coarse foam 48 above a reticulated ice sub-layer of frozen foam 44, such being illustrated in FIG. 5. On the whole, the foam layer 40 retains its thickness over time. Desirably, the refrigeration equipment (freezing the ice rink) is turned off at about the time the foam layer is applied, and is restarted at about the time the foam layer is removed.

It is preferred that the operator refrain from resurfacing the ice rink surface at the end of the day use period. Advantageously, the rink operator may allow the snow to remain on the ice sheet when the foam is applied. Resurfacing may be accomplished when the foam is removed as an incident to foam removal.

When the ice rink is completely covered with foam, and just before exiting from the ice sheet, the operator of the resurfacer will cease further generation of foam by appropriate switching at controller 20. Of course, such is desired so that foam will not be laid down on entrance or exit runways.

As has already been indicated, the foaming sub-assembly may be an add-on accessory for a conventional resurfacer. Preferably, the foam generator is adapted to be substituted removably for the water spreading towel bar. Alternatively, the foam spreading accessory may be constructed for permanent mounting on the resurfacer through a pivotal connection which enables this unit to be uncoupled to swing clear of water line 17 so that the towel bar 32 may be attached to (and removed from) resurfacer 10. The towel bar would, of course, be reattached prior to employment of resurfacer 10 for resurfacing of the ice rink incident to subsequent removing of the foam.

To remove the aged foam, the operator of the resurfacer follows normal procedure for ice resurfacing, which procedure includes filling the resurfacer water tank 12 with hot water. Thus, the operator resurfaces as normal removing the foam by the scraping action carried out with the resurfacer (to remove snow accumulation). As has already been pointed out, the foam does not regenerate as such under shear and agitation; instead it collapses to a substantial extent under the stresses imposed when scraped off the ice surface and pushed into a pile. As the resurfacer carries out normal resurfacing, all of the foam blanket will be lifted off the ice rink surface into the snow holding tanks of the resurfacer along with the snow produced from the skating activity of the previous day (should this not have already been removed). The snow and foam can be dumped into a snow melting pit and allowed to drain away.

Applying the foam requires only 15–30 minutes. Removing the foam may take a bit longer. It is noted, however, that the resurfacing operation which takes place incident to removing the foam would be carried out in any event and, therefore, only the foam spreading time and the time required for equipment switching is added to normal ice rink operating procedures.

Although, for simplicity, the foregoing description of the invention has been posed within the context of an enclosed ice rink, it should be appreciated that open-to-the-air ice rinks are operated when air temperatures climb above freezing, and also that other ice surfaces exist which may require insulation e.g., curling rinks, luge and bobsled runs, even ski-jumps. Practice of this invention is applicable to insulation of such surfaces, particularly to refrigerated frozen surfaces.

Although the foregoing discussion and description of this invention has been posed in terms of state-of-the-art foam concentrates and foaming equipment, only small-scale tests have been conducted as of the date hereof. The tests, however, are simulative of ice rink conditions. The details of one such test study are provided below as a specific example to practice of the invention and in aid of practice of the invention on ice rinks.

An ice sheet surface of about 8 square feet (about 4" deep) was formed over copper tube refrigerating coils laid in a walled-off area (on top of a storage cabinet). After the walled-off area was filled with water, chilled 15° F. ethylene glycol was circulated through the coils until the solid ice sheet was generated.

A mixture of water and the commercial foam liquid National High Expansion Foam Liquid (National Foam Systems, Inc.) in the recommended 1½ (V/V) proportion was foamed by air aspiration into a cardboard box foam collector and spreader and from there spread to a depth of about 3" over about 50% of the ice surface. Then refrigeration was halted. At that moment the ice temperature was 17° F.; ambient temperature was 65° F. After 1½ hours, the ice temperature in the exposed region of the ice sheet had risen to 27° F. and the ice surface had begun to show signs of moisture. The ice temperature under the foam covered half of the ice sheet had risen only to 20° F. (about a 3° F. rise) and about ⅛–¼" frozen foam had formed against the ice sheet.

Calculations indicate about a 70% reduction in heat absorption by the ice under the foam had resulted.

In time (about six hours) the temperatures of both halves of the ice sheet equalized, but equilization of temperature is attributed to heat transfer laterally throughout the relatively small ice sheet from exposed region to foam covered region.

After eight hours, the thickness of the foam layer had not yet diminished materially, but the foam had aged.

We claim:

1. A method for reducing the refrigeration load on frozen surface during non-operating periods which comprises:

applying a metastable liquid foam directly on the frozen surface upon commencement of a non-operating period of time, thereby insulating the frozen surface from the ambient air;

allowing the foam layer to remain quiescent throughout the non-operating period, during which period the foam undergoes aging and at least partial freezing; and at the expiration of the non-operating period removing the aged and frozen foam from the frozen surface.

2. The process of claim 1 which further comprises resurfacing the frozen surface at the same time as the aged and frozen foam is being removed from the surface.

3. The process of claim 1 which further comprises applying a foam layer of at least 2" in thickness.

4. The process of claim 1 which further comprises applying a foam containing a biodegradable proteinatious foaming agent.

5. The process of claim 1 which further comprises adding at least about 1% of a foam liquid concentrate to water then foaming the resulting mixture.

6. The process of claim 5 which further comprises discontinuing refrigeration of the frozen surface while the foam layer is present thereon.

* * * * *